US005469792A

United States Patent [19]

Lenk

[11] Patent Number: 5,469,792

[45] Date of Patent: Nov. 28, 1995

[54] RAILBORNE VEHICLE HAVING ARTICULATED BEAM CONNECTION SYSTEM BETWEEN CARRIAGES

[75] Inventor: Leopold Lenk, Vienna, Austria

[73] Assignee: SGP Verkehrstechnik Gesellschaft m.b.h., Wien, Australia

[21] Appl. No.: 161,303

[22] Filed: Dec. 2, 1993

[30] Foreign Application Priority Data

Sep. 6, 1993 [AT] Austria ..... 1120/93

[51] Int. Cl.[6] ..... B61D 17/00

[52] U.S. Cl. ..... 105/4.1; 105/4.4

[58] Field of Search ..... 105/4.1, 4.4, 8.1; 280/400, 403, 442, 443, 488

[56] References Cited

U.S. PATENT DOCUMENTS 1,880,953 10/1932 Fageol ..... 105/4.4

FOREIGN PATENT DOCUMENTS 291681 5/1987 European Pat. Off. .
443309 2/1990 European Pat. Off. .
1409268 7/1965 France ..... 105/4.1
2374195 7/1978 France .
669145 12/1938 Germany ..... 105/4.1
1010092 2/1955 Germany .
1105445 4/1961 Germany .
1530086 1/1965 Germany .
2060231 12/1970 Germany .
2123876 5/1971 Germany .
2256764 11/1972 Germany .

*Primary Examiner*—Robert J. Oberleitner
*Assistant Examiner*—S. Joseph Morano
*Attorney, Agent, or Firm*—Jacobson, Price, Holman & Stern

[57] ABSTRACT

Railborne vehicle comprising a gantry bogey, provided between mutually opposite ends of two successive carriages. A bottom plate 1, 2 projects from each of both carriage body ends to form a passage between the carriages. The two bottom plates 1, 2 are interconnected by a joint, preferably a spherical joint 3. In order to transmit the forces resulting from lateral torsional deformations of the carriage superstructure when negotiating curves and arising from uneven tracks, the bottom plates 1, 2 are interconnected by connecting beams 11 which are flexible and torsionally deformable and are connected at their ends by resilient connections to the bottom plates 1, 2.

25 Claims, 5 Drawing Sheets

RAILBORNE VEHICLE HAVING ARTICULATED BEAM CONNECTION SYSTEM BETWEEN CARRIAGES

BACKGROUND OF THE OBJECTS OF THE INVENTION

The invention relates to a railborne vehicle composed of at least two carriages, preferably connected by a spherical joint with the adjoining ends of successive carriages comprising projecting mutually opposing bottom plates or the like forming a passage between the two carriages and which are interconnected preferably in semimounted fashion, there being provided between the two carriages a bogey, preferably a gantry bogey having mutually opposing driven loose wheels. Such vehicles have suffered from certain disadvantages.

An object of the invention is the provision of a system which serves to place the wheels of the railborne vehicle, when negotiating curves, always into the angle hi-setting line, for which purpose earlier vehicles were equipped with lemniscate guide rods, which where substantially more expensive in their construction and maintenance.

A further object of the present invention in the context of the present railborne vehicle, is to provide for loose wheel bogeys, without rigid axial connection between mutually opposing wheels, the same running characteristics which apply to the self-centering conventional wheel sets having a rigid transverse connection between the wheels.

GENERAL DESCRIPTION OF THE INVENTION

According to the present invention there is provided a railborne wherein the adjoining ends of successive carriages each include a bottom plate which are interconnected by at least one flexible and torsionally deformable connecting beam which at its one end, by way of a guide rod, is connected to the carriage superstructure or the bottom plate of one of the two successive carriages. The connecting beam is connected at its opposite ends to both arms of a double-armed lever, transverse beam or the like of the other carriage and which in its longitudinal center is pivotally mounted about a vertical axis to the bottom plate and the carriage superstructure, and by way of its two arms is connected to the loose wheels via guide rods.

Advantageously, the connecting beam is designed in mirror image fashion about a central axis of the two successive carriage superstructures during rectilinear travel of the carriages. Preferably, the connecting beam is formed of two parts converging towards the end preferably in the form of leaf springs, and the ends of the connecting beams which are further apart are linked to a transverse beam which in its longitudinal center is elastically connected to the bottom plate. Also preferably, in a saddle-like interrelationship of the two bottom plates one on top of the other, the transverse beam is connected to the uppermost bottom plate.

In a preferred embodiment, on the mutually facing inner ends of the bottom plate, a tracking plate extending transversely to the direction of travel is saddled which is pivotable about the vertical axis of the joint interconnecting the bottom plates. Each end of the tracking plate, viewed transversely to the direction of travel includes a guide rod linked thereto. The other end of each guide rod is linked to the transverse beam. Preferably the connection of the tracking plate to the guide rods is performed by way of a bolt carried by the wheel casing and permits a vertical movement of the linkage position of the tracking plate.

Also, advantageously, the transverse beam is pivotally mounted about a joint on a plate which at its two edges on opposite sides of the joint viewed transversely to the direction of travel, is connected to the bottom plate by way of rubber elastic panels.

Preferably the converging ends of the connecting beams are connected to the bottom plate with the interposition of a common mounting plate and a guide rod. The ends of the connecting beam are fitted on the mounting plate or onto the transverse beam as the case may be, by way of bolts with shearing bushes, tight-fitting bolts, or the like. In that embodiment it is preferred that the connecting beams extend below the bottom plate and access apertures are provided at least for fitting the connecting beam onto the mounting plate. Also preferably, the guide rod bracket linking the mounting plate to the bottom plate extends obliquely to the longitudinal central plane in rectilinear travel of the two carriage superstructures, and at its one end in the longitudinal central plane, is pivotally mounted by way of a bolt to the mounting plate, and at its opposite end, is mounted by means of a resilient mounting to the bottom plate. Such a resilient mounting between the guide rod and the bottom plate comprises a rubber plate clamped between two rings. The vertical pivotal axis of the joint between the bottom plate and the transverse beam, the pivoting axis of the joint between the two bottom plates, and the pivoting axis of the bolt between the guide rod and the mounting plate, are advantageously located in a joint vertical central plane extending in the direction of travel. The distances of the vertical pivotal axis of the joint of the transverse beam and the connecting bolt of the guide rod on the mounting plate from the joint of the two bottom plates in the central position of the two carriage superstructures, during rectilinear travel thereof, are equal.

In order to attain the second aforesaid object, the invention teaches that the guide rod is connected to the carriage superstructure, the bottom plate or the like by way of an eccentric. Preferably, the eccentric is seated in a bearing, is driven in the case of carriages travelling preferably at a velocity exceeding 18 km/h, and comprises an eccentrically fitted bolt which moves the connecting link of the guide rod to the connecting beam to and fro and at a pre-determined rhythm transversely to the direction of travel. More particularly, only a single torsionally deformable, preferably triangular connecting beam, is provided, which during rectilinear travel of the carriages, is designed in mirror image fashion in relation to a central axis of the two successive carriage superstructures, and at its one end is connected to the guide rod, and its other end to the double armed lever, transverse beam, or the like, symmetrically to a pivoting axis thereof. In a specific such embodiment the distance of the pivoting point of the guide rod from the vertical axis of the spherical joint is equal to the distance of the vertical pivoting axis of the joint from the vertical pivoting axis of the spherical joint.

BRIEF DESCRIPTION OF THE DRAWINGS

The invention will be further explained with reference to the drawings in which two working examples invention are illustrated. There is shown in FIG. 1 a plan view of the connection between adjoining ends of two successive carriages travelling in a straight path.

DETAILED DESCRIPTION OF SPECIFIC EMBODIMENTS

Figure 3:
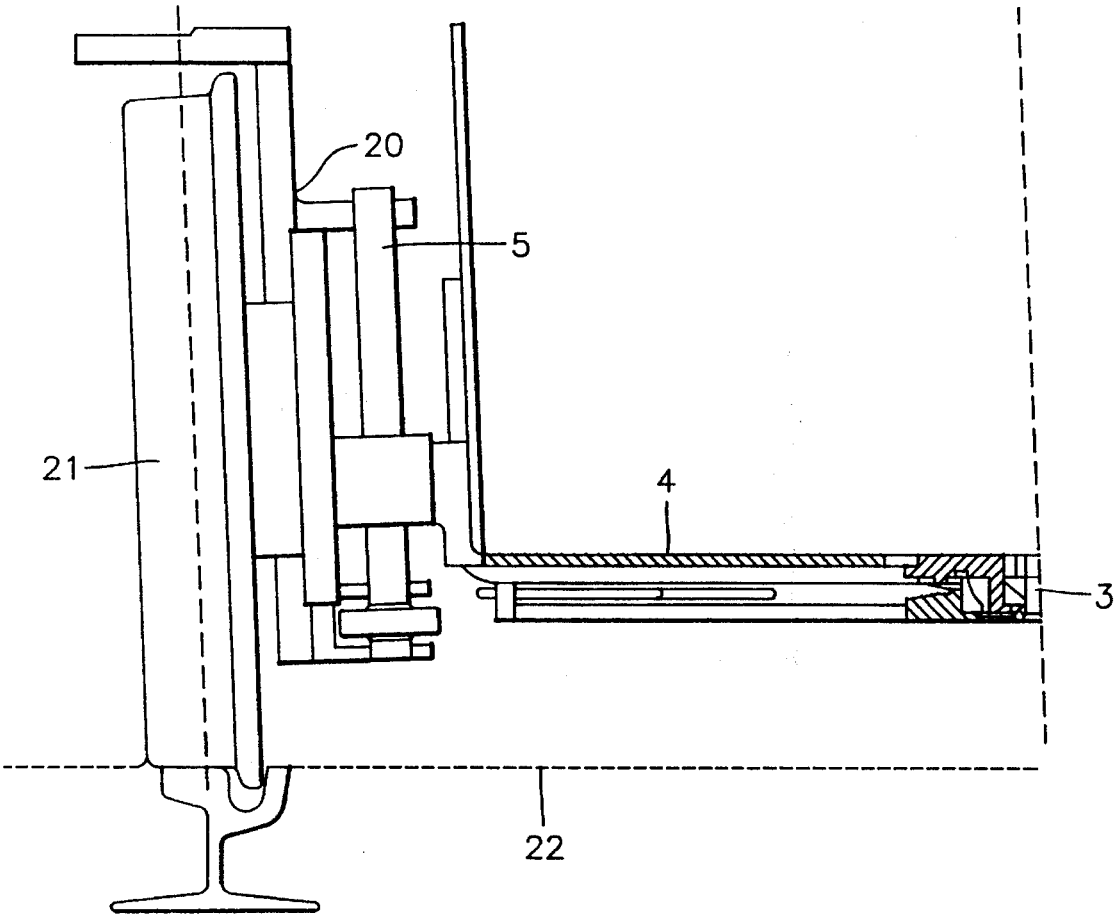

Reference numbers 1 and 2 each denote a bottom plate which projects from the respective end of a carriage superstructure. The two bottom plates of mutually opposing carriages are semimounted, one on the other in the terminal region with the interposition of a spherical joint 3. A tracking plate 4 is applied onto the connecting position of the two bottom plates 1, 2 which extends transversely to the direction of travel and is pivotable about the vertical axis of the spherical joint 3. The two ends of the tracking plate 4 are pivotable about a pin 5 and level adjustably mounted thereon. The pin as shown in FIG. 3 is fitted to the wheel case 20 of the respective loose wheel 21. Reference number 22 denotes the plane of the upper edge of the rail.

Figure 1:
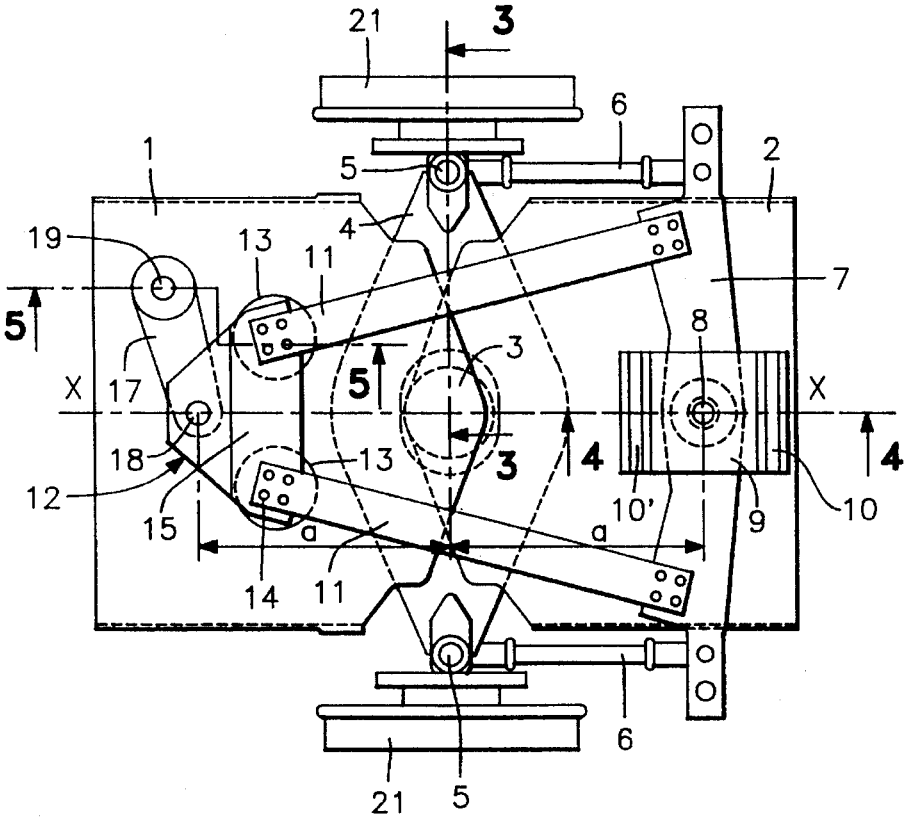
Figure 2:
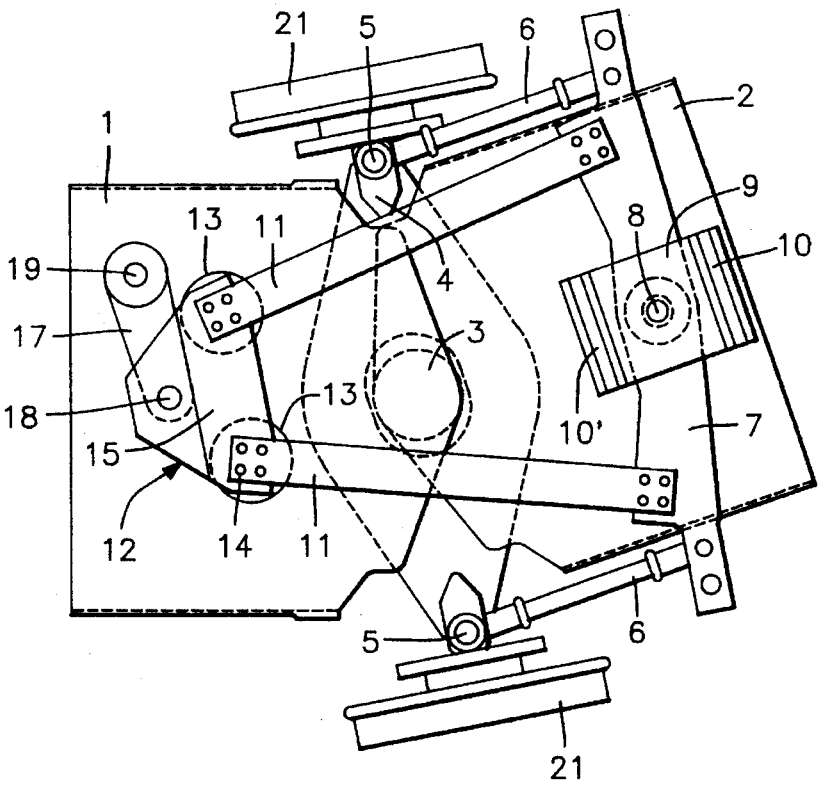
FIG. 2 a plan view of the connection when the carriages are negotiating a curve, FIG. 3 a section view taken section along line HI—III on FIG. 1, FIG. 4 a section view taken section along line IV—IV on FIG. 1, FIG. 5 a section view taken section along line V—V on FIG. 1, FIG. 6 a plan view of a second embodiment of a connection between adjoining ends of two successive carriages travelling in a straight path, FIG. 7 a plan view of the connection when the carriages are negotiating a curve, FIG. 8 as a plain view of a connection composed of a single triangular connecting beam and FIG. 9 a plan view of a different connection composed of a single connecting beam.
Figure 4:
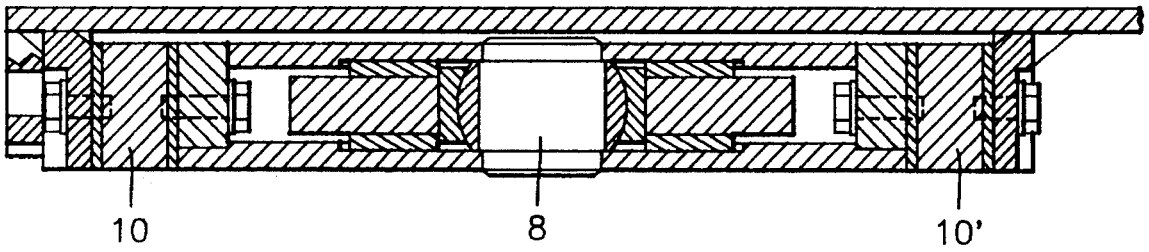
Figure 5:
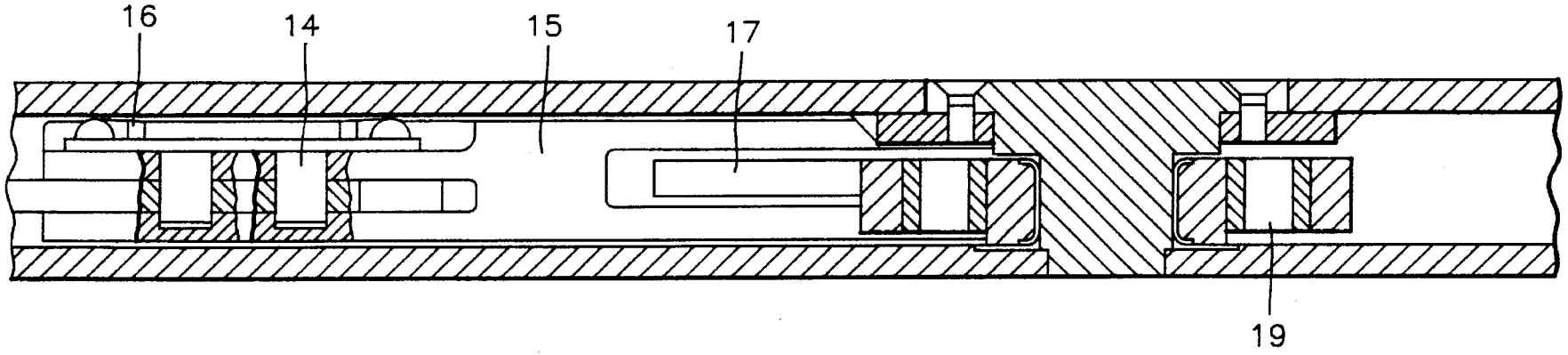
Figure 6:
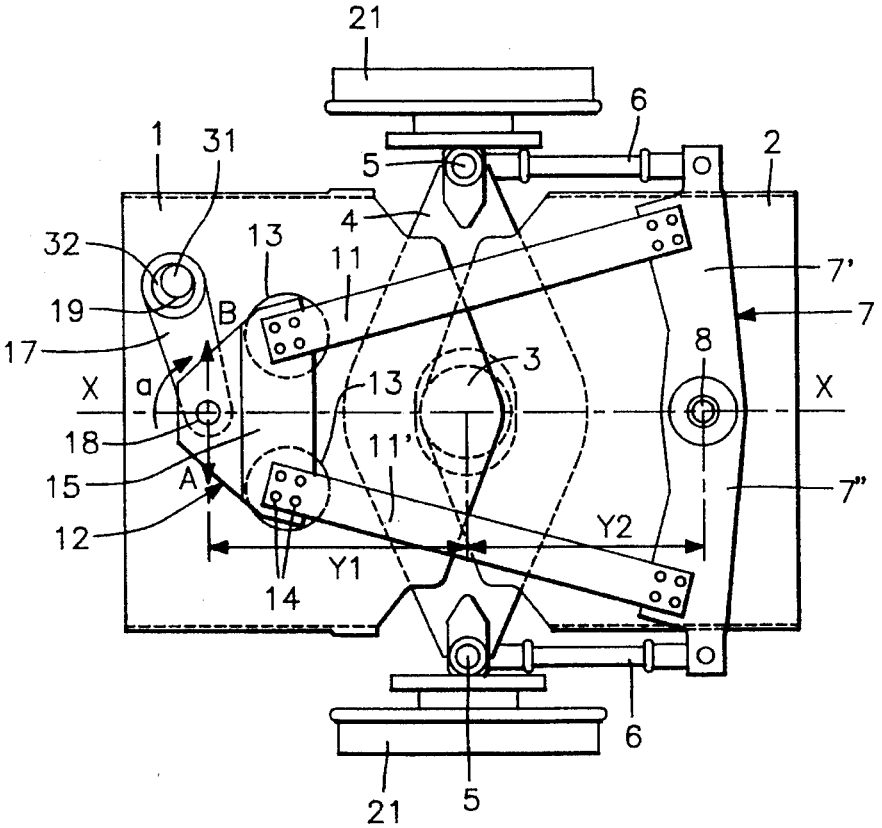
Figure 7:
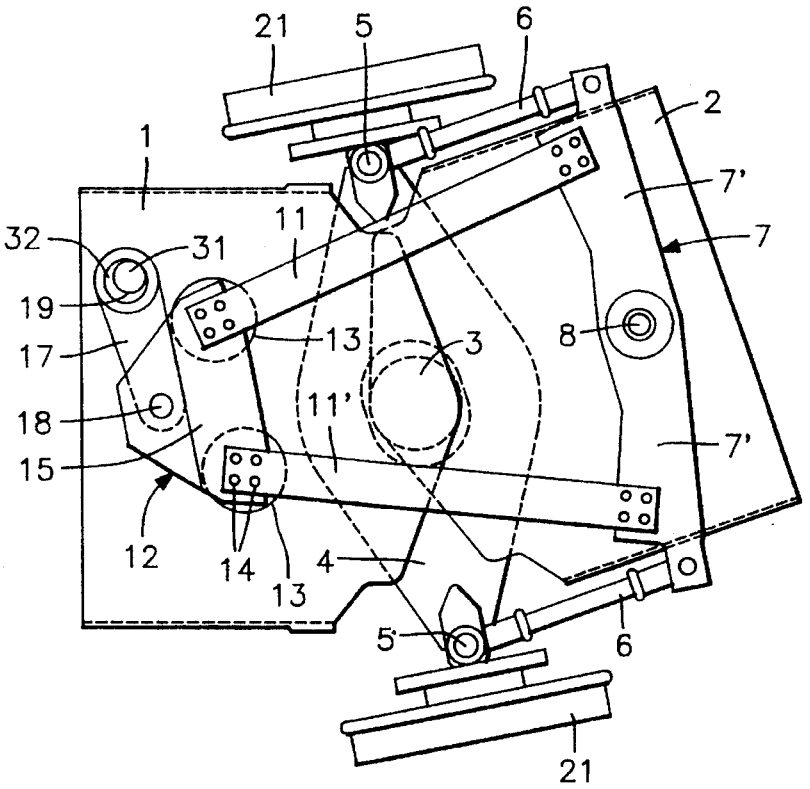

As can be seen from FIG. 1 and 2 each pin 5 has linked thereon a guide rod 6 which is linked at its end remote from the pin 5 to a transverse beam 7 linked about a joint 8 on the bottom plate 2, which plate 2 is semimounted on the plate 1 with the intervention of the afore-said spherical joint 3. The joint 8 is mounted in a plate 9 of which the two transverse edges opposing each other in the direction of travel are fitted each to a rubber elastic plate 10, 10' as shown in FIG. 4, and which in turn is fixed to the bottom plate 2, for example by bolting.

The two bottom plates 1, 2 are interconnected by at least one flexible and torsionally deformable connecting beam 11, e.g. a leaf spring having appropriate properties.

These two leaf springs 11 are connected at their one end by way of a mounting plate 12 to the bottom plate 1, whereas the opposite end of the leaf spring 11 is connected to the transverse beam 7. The two mounting ends of the leaf springs 11 on the mounting plate 12 are provided equidistant from the longitudinal central axis X. The two leaf springs 11 extend in mirror image relationship to the longitudinal axis X diverging towards the transverse beam 7. The leaf springs 11 or the like must accommodate both torsional as well as bending loads of the two successive carriage superstructures, as arise in particular when negotiating curves and when inclined. The two leaf springs 11 are fixed to the mounting plate 12 by means of screws 14 and sheafing bushes, close tolerance bolts, or the like. Access apertures 13 are provided in the bottom plate 1, through which the screw connecting of the leaf springs 11 can be performed. The mounting plate 12 is held together between two plates 15 by bolts 16 and guided by way of a guide rod 17 which at its one end is linked by way of a bolt 18 to the mounting plate 12. The other end of the guide rod 17 is linked by way of a rubber elastic bearing 19 to the bottom plate 1. The rubber mounting serves the object of, on the one hand, dampening noise derived from the above described system, and on the other hand, permits a degree of lateral movements of the gantry structure. The rubber elastic bearing 19 is composed of two concentric rings between which a rubber panel is clamped.

The fitting of the leaf springs 11 to the cross beam 7 proceeds in the same manner as the fitting of the leaf springs 11 onto the mounting plate 12.

An important feature of the invention also resides in that the vertical pivoting axis of the joints 8, 3 and 18, in rectilinear travel as illustrated in FIG. 1 of successive carriage superstructures, lie in a common central plane indicated by the axis X, and the distance between the vertical axis of the joint 8 and the vertical axis of the spherical joint 3 equals the distance of the vertical pivoting axis of bolt 18 from the vertical axes of the spherical joint 3.

It is a further feature of the invention that the guide rod 17 which connects the mounting plate 12 to the bottom plate 1 during rectilinear travel of the two carriage superstructures, extends obliquely to the longitudinal central plane X and is mounted pivotally at its one end in the longitudinal central axis by means of a bolt on the mounting plate 12, and at its other end is mounted by way of an elastic mounting 19 on the bottom plate 1.

In the embodiment according to FIGS. 6 to 9, components corresponding to those of the earlier embodiment are denoted by the same reference numbers. The connecting beams are denoted as 11, 11' and are linked at their one end by way of a mounting plate 12 to a guide rod 17 at 18 and at their opposite end by means of one arm 7', 7" each of a cross beam 7 in mirror image relationship to the joint 8. The guide rod 17 extends at an acute angle Alpha to the axis X—X, and at its end facing away from the mounting plate 12, comprises a beating means 19 for accommodating a hydraulically, mechanically, or pneumatically, driven shaft 32 having an excentrically positioned bolt.

The distance Y1 of the pivoting point 18 from the vertical axis of the spherical joint 3 equals the distance Y2 of the vertical pivoting axis of the linkage 8 from the vertical pivoting axis of the spherical joint 3.

The construction according to the invention causes the pivoting of the eccentric bolt 31 to bring about a to and fro movement of the joint 18 in the direction of the arrow A–B, bringing about a sinusoidal movement. This sinusoidal movement is repeated by the excentric bolt 31 during the travelling of the carriage. This cyclic-countercyclic control is introduced preferably at a minimum velocity of 18 km/h, since otherwise the wheels at the control stand would move back and forth without interruption.

Figure 8:
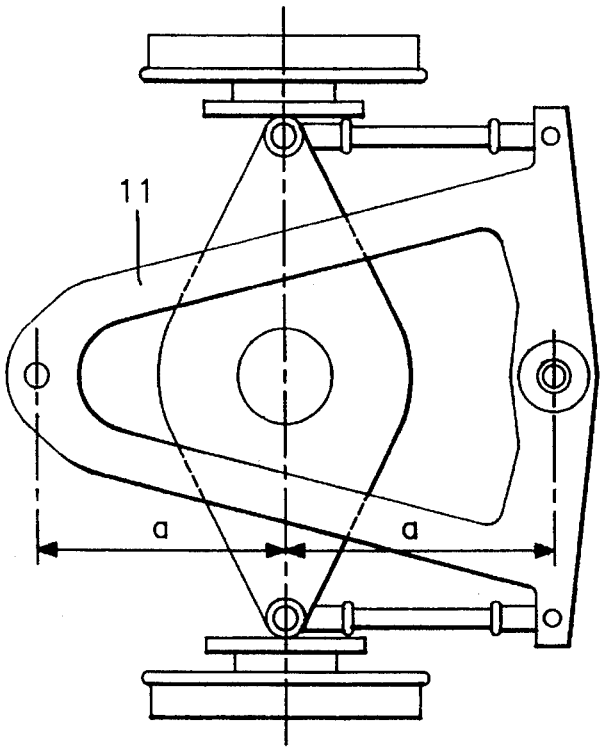
Figure 9:
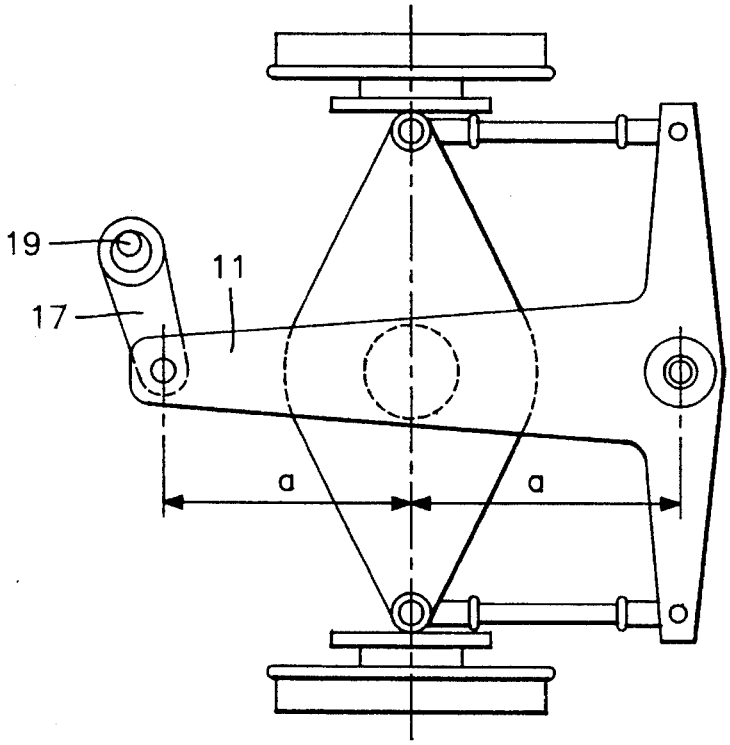

It stands to reason that within the scope of the invention, different constructional modifications with regard to the design of the connecting beams 11 can be performed. In the design of the connecting beam according to FIGS. 8 and 9, a single connecting beam only is provided which in FIG. 8 is of triangular configuration. In both cases the tip thereof must be linked by way of the guide rod 17, and as described above by way of the bearing 19 and the eccentric bolt 31 to the carriage.

In each case, the pivoting axis of the wheels must pass through the pivoting axis of the spherical joint 3. The connection of the one or more connecting beams 11 to the cross beam 7 must be rigid. The bearing 19 is preferably elastic according to the principle of a rope block guide. The resilient connection provides a certain freedom of movement for the triangular system of the one or more connecting beams.

The system according to the invention functions only if the wheels are driven and the cycle-countercycle control is functional so that the symmetrical control performs a movement in order to set the wheels at different inclinations to the rail.

What we claim is:

1. Railborne vehicle composed of at least two carriages having adjoining ends, forming a carriage consist, the adjoining ends of successive carriages comprising projecting mutually opposing bottom plates forming the passage between the two carriages, there being provided between the two carriages a bogey, wherein the bogey has mutually opposing driven loose wheels and wherein the adjoining ends of the two bottom plates are interconnected in semi-mounted fashion and pivotal about the vertical axis of an interposed spherical joint, the said two adjoining ends are interconnected by at least one connecting beam which at its one end, by way of a first guide rod is connected to the bottom plate of one of the two successive carriages by means of a resilient mounting and with its opposite end to both arms of a transverse double-armed beam of the other carriage and which in its longitudinal center is pivotally mounted about a vertical axis to the bottom plate of the said other carriage and by way of its two arms is connected to the loose wheels via second guide rods.

2. Railborne vehicle according to claim 1, wherein the connecting beam is designed in mirror image fashion about a central axis of the two successive carriage superstructures during rectilinear.

3. Railborne vehicle according to claim wherein the connecting beam is formed of two flexible and torsionally deformable parts converging towards the end being connected to the said first guide rod.

4. Railborne vehicle according to claim 3, wherein the ends which are further apart of the connecting beam parts are linked to the transverse beam which in its longitudinal center is elastically connected to the bottom plate of said other carriage.

5. Railborne vehicle according to claim 4, wherein on mutually facing inner ends of the bottom plate a tracking plate extending transversely to the direction of travel is saddled which is pivotable about the vertical axis of the joint interconnecting the bottom plate, and at each of its ends viewed transversely to the direction of travel, said second guide rods are linked at that end which is remote to the tracking plate which is linked to the transverse beam.

6. Railborne vehicle according to claim 5, wherein the connection of the tracking plate to the second guide rods is performed by way of a bolt carried by the wheel casing and permits a vertical movement of the linkage position of the tracking plate.

7. Railborne vehicle according to claim 4, wherein in a saddle, interrelationship of the two bottom plates one on top of the other, the transverse beam is connected to the uppermost bottom plate.

8. Railborne vehicle according to claim 7, wherein the transverse beam is pivotally mounted about a second joint on a plate which at its two edges on opposite sides of the second joint viewed transversely to the direction of travel, is connected to the bottom plate of said other carriage by way of rubber elastic panels.

9. Railborne vehicle according to claim 3 wherein the converging ends of the connecting beam are connected to the said bottom plate of the said one of the two successive carriages with the interposition of a common mounting plate and said first guide rod.

10. Railborne vehicle according to claim 9, wherein the two converging ends of the connecting beam parts are fitted on the mounting plate or onto the transverse beam by way of bolts with shearing bushes.

11. Railborne vehicle according to claim 10, wherein the connecting beam parts extend below the bottom plate, and access apertures are provided at least for fitting the connecting beam onto the mounting plate.

12. Railborne vehicle according to claim 9, wherein a guide rod bracket linking the mounting plate to the bottom plate of said one carriage extends obliquely to the longitudinal central plane in rectilinear travel of the two carriage superstructures and at its one end in the longitudinal central plane is pivotally mounted by way of a bolt to the mounting plate and at its opposite end is mounted to the bottom plate of said one carriage.

13. Railborne vehicle according to claim 12, wherein the resilient mounting between the first guide rod and the bottom plate of said one carriage comprises a rubber plate clamped between two rings.

14. Railborne vehicle according to claim 13, wherein the vertical pivotal axis of the second joint between the bottom plate of said other carriage and the transverse beam, the pivoting axis of the spherical joint between the two bottom plates and the pivoting axis of the bolt between the first guide rod and the mounting plate are located in a common vertical central plane extending in the direction of travel.

15. Railborne vehicle according to claim 14, wherein the distances of the vertical pivotal axis of the second joint of the transverse beam and the connecting bolt of the first guide rod on the mounting plate from the spherical joint of the two bottom plates in the central position of the two carriage superstructures, during rectilinear travel thereof, are equal.

16. Railborne vehicle according to claim 3, wherein the two parts are in the form of leaf springs.

17. Railborne vehicle composed of at least two carriages having adjoining ends, forming a carriage consist, the adjoining ends of successive carriages comprising projecting mutually opposing bottom plates forming the passage between the two carriages, there being provided between the two carriages a bogey, wherein the bogey has mutually opposing driven loose wheels and wherein the adjoining ends of the two bottom plates are interconnected in semi-mounted fashion and pivotable about the vertical axis of an interposed spherical joint, the said two adjoining ends are in interconnected by at least one connecting beam which at its one end, by way of a first guide rod is connected to the bottom plate of one of the two successive carriages and wherein the first guide rod is connected to the carriage superstructure or the bottom plate of said one carriage by way of an eccentric and with its opposite end to both arms of a transverse double-armed lever of the other carriage and which in its longitudinal center is pivotally mounted about a vertical axis to the bottom plate of the said other carriage and by way of its two arms is connected to the loose wheels via second guide rods.

18. Railborne vehicle according to claim 17, wherein the eccentric is seated in a bearing and s driven in the case of carriages travelling at a velocity exceeding 18 km/h, and comprises an eccentrically fitted bolt which moves a connecting link of the first guide rod to the connecting beam to and fro and at a pre-determined rhythm transversely to the direction of travel.

19. Railborne vehicle according to claim 17, wherein only a single torsionally deformable connecting beam is provided which during rectilinear travel of the carriages is designed in mirror image fashion in relation to a central axis of the two successive carriage superstructures and at its one end is connected to the first guide rod and its other end to the double armed lever symmetrically to a pivoting axis thereof.

20. Railborne vehicle according to claim 19, wherein one tip of the connecting beam is connected to the first guide rod whereas two other tips of the connecting beam are connected to the two arms of the double armed lever, transverse symmetrically to the pivoting axis of the lever.

21. Railborne vehicle according to claim 19, wherein the deformable connecting beam is triangular.

22. Railborne vehicle according to claim 17, wherein the distance of a pivoting point of the first guide rod from the vertical axis of the spherical joint is equal to the distance of the vertical pivoting axis of the second joint from the vertical pivoting axis of the spherical joint.

23. Railborne vehicle according to claim 17, wherein the connecting beam is formed of two flexible and torsionally deformable parts converging towards the end being connected to the said first guide rod.

24. Railborne vehicle according to claim 23, wherein the converging ends of the connecting beam are connected to the said bottom plate of the said one of the two successive carriages with the interposition of a common mounting plate and said first guide rod.

25. A rail supported vehicle having at least two carriages provided with adjacent ends, each adjacent end having a plate projecting from a bottom area thereof and oriented with one plate partially overlying the other plate, a spherical joint connecting the overlying portions of said plates to enable pivotal movement of the plates about a vertical axis, a tracking plate extending transversely of the path of travel of the vehicle and connected with said spherical joint for pivotal movement about a vertical axis, a rail engaging-wheel and wheel case at each end of said tracking plate, a vertical pin connecting each wheel case to an end of said tracking plate, a transverse beam mounted on one of said plates and having ends spaced longitudinally from said pins, guide rods interconnecting the ends of the transverse beam and said pins, said transverse beam having a central portion supported on said one of said plates, a mounting plate oriented above the other of said plates, resilient connecting beams interconnecting the ends of the transverse beam and said mounting plate, a supporting and guiding rod for said mounting plate having one end connected to said mounting plate and extending laterally therefrom, said supporting and guiding rod having its other end connected to the other of said plates by a resilient connection to permit resilient limited movement of said mounting plate and connecting beams when the wheels negotiate a curve in the rails.

* * * * *